US005803887A

United States Patent [19]

Fukunaga

[11] Patent Number: 5,803,887

[45] Date of Patent: Sep. 8, 1998

[54] HEAT-FIXING ROLL FOR FIXING DEVICE

[75] Inventor: Noritomo Fukunaga, Tokyo, Japan

[73] Assignee: Kinyosha Co., Ltd., Tokyo, Japan

[21] Appl. No.: 885,133

[22] Filed: Jun. 30, 1997

[51] Int. Cl.[6] ..... B25F 1/00

[52] U.S. Cl. ..... 492/59; 492/56; 428/447

[58] Field of Search ..... 492/56, 54, 59, 492/58, 53; 428/36.92, 447

[56] References Cited

U.S. PATENT DOCUMENTS 4,438,063 3/1984 Suguri et al. ..... 492/59
5,434,653 7/1995 Takizawa et al. ..... 492/59
5,443,873 8/1995 Itani et al. ..... 492/59
5,582,885 12/1996 Nakamura et al. ..... 492/59
5,582,917 12/1996 Chen et al. ..... 492/56
5,679,463 10/1997 Visser et al. ..... 428/447

*Primary Examiner*—Irene Cuda
*Attorney, Agent, or Firm*—Oblon, Spivak, McClelland, Maier & Neustadt, P.C.

[57] ABSTRACT

A heat-fixing roll which includes a core shaft, and a rubber layer formed on an outer peripheral surface of the core shaft, wherein the rubber layer is formed of a silicone rubber compound of addition reaction curing type having a thermal conductivity of $1.5\times10^{-3}$cal/cm·sec·°C. or more and containing 1.5 parts by weight or more of silicone resin powder having an average particle diameter of 1 to 20 $\mu$m.

4 Claims, 2 Drawing Sheets

HEAT-FIXING ROLL FOR FIXING DEVICE

BACKGROUND OF THE INVENTION

This invention relates to a heat-fixing roll, and in particular to a heat-fixing roll for a fixing device which is adapted to be employed together with a pressure roll in electrophotographic copying machine such as a high-speed copying machine, a facsimile terminal equipment or a printer.

A fixing device as shown in FIG. 1 has been conventionally known. Referring to FIG. 1, the fixing device comprises a heat-fixing roll 10 and a heat pressure roll 20 which is arranged parallel with the heat-fixing roll 10 so as to form a nipping portion therebetween. The heat-fixing roll 10 is mainly composed of a hollow core shaft 12 housing therein a heater 11, and a heat resistant rubber elastic layer 13 covering the outer peripheral surface of the hollow core shaft 12. The heat resistant rubber elastic layer 13 is adapted to be heated up to about 230° C. by the heater 11.

On the other hand, the heat pressure roll 20 is mainly composed of a hollow core shaft 22 housing therein a heater 21, and a heat resistant resin layer 23 covering the outer peripheral surface of the hollow core shaft 22. The unfixed toner 25 which is transferred to a base material 24 such as a sheet of paper or film will be fixed thereon by heat and pressure as it is passed through the aforementioned nipping portion, and hence turned into a fixed toner 26. Furthermore, for the purpose of improving the releasability of heat-fixing roll 10 in relative to the toner, silicone oil 27 is supplied via a donor roll 28 to the heat-fixing roll 10 and coated thereon.

In addition to the fixing device shown in FIG. 1, there are also known other kinds of fixing device, e.g. a fixing device which is provided with a heat pressure roll whose core shaft is covered on the outer peripheral surface thereof with a rubber elastic layer instead of a heat resistant resin layer; or a fixing device provided with a heat pressure roll whose core shaft is covered on the outer peripheral surface thereof with a two-ply layer, i.e. a rubber elastic underlayer and a heat resistant resin layer coated over the rubber elastic underlayer.

Examples of material for the rubber elastic layer to be covered on the outer peripheral surface of heat pressure roll of these fixing devices are a silicone rubber (for example, U.S. Pat. No. 3,666,247; U.S. Pat. No. 4,064,313; U.S. Pat. No. 4,925,895; and U.S. Pat. No. 5,336,539), a pheynylsilicone rubber (for example, Japanese Unexamined Patent Publication) No. Shou/59-209129), a fluorosilicone rubber (for example, Japanese Unexamined Patent Publication No. Hei/3-26947), fluororubber (for example, Japanese Unexamined Patent Publication No. Shou/56-135876; and U.S. Pat. No. 4,272,179), and other materials (for example, U.S. Pat. No. 3,763,158; U.S. Pat. No. 4,064,313; and U.S. Pat. No. 5,035,927).

A rubber elastic layer to be employed for a heat pressure roll which is used under the severe conditions of a high temperature, a high load and a high rotational speed is required to have an excellent durability for withstanding the abrasion by paper sheet. With a view to improve the durability, the heat resistant rubber elastic layer 13 in the heat-fixing roll shown in FIG. 1 contains alumina ($Al_2O_3$), boron nitride (BN), silicon carbide (SiC), quartz powder ($SiO_2$) or metallic powder so as to enhance the thermal conductivity of the heat resistant rubber elastic layer 13, thus making it possible to perform a high speed fixing of toner onto paper (see for example, U.S. Pat. No. 3,763,158; or Japanese Unexamined Patent Publication No. Hei/8-272253).

Meanwhile, since the heat resistant rubber elastic layer 13 is heated up to a temperature of as high as 230° C. by the heater 11, a rubber material which is excellent in heat resistance such as silicone rubber or fluororubber has been generally employed. When silicone rubber is employed as a rubber material, the base compound thereof is low in hardness, so that a thermal conductivity-improving agent can be added to the silicone rubber in a high concentration, thus making it possible to sufficiently thicken the thickness of the heat resistant rubber elastic layer 13 so as to assure a sufficient nipping width. On the other hand, when fluororubber is employed as a rubber material, the base compound thereof is high in hardness, so that only a limited amount of a thermal conductivity-improving agent can be added to the fluororubber, thus making it impossible to sufficiently thicken the thickness of the heat resistant rubber elastic layer 13. Therefore, the outer diameter of heat fixing roll is required to be enlarged, or otherwise the thickness of the rubber elastic layer 13 is required to be thinned.

Under the circumstances, a heat fixing roll shown in FIG. 2 has been proposed, wherein the heat fixing roll comprises a core shaft 31, and a heat resistant rubber elastic layer 32 covering the outer peripheral surface of the core shaft 31 and formed of a silicone rubber containing a large amount of a thermal conductivity-improving agent such as alumina ($Al_2O_3$). This heat fixing roll is accompanied with a problem that abrasions 34 are caused to be generated at the portions of heat resistant rubber elastic layer 32 that correspond to the side edges of paper sheet 33, resulting in a defective feeding, a wrinkling or a curling of paper sheet. Due to the formation of abrasions 34 on the heat fixing roll, the heat fixing roll is required to be frequently exchanged to new one. This modification method is described for example in Japanese Unexamined Patent Publication No. Hei/8-76625. The aforementioned problem can be ascribed mainly to the lowering of physical strength of rubber resulting from a large content of thermal conductivity-improving agent. However, since the abrasion mechanism by paper sheet is complicated, any clear solution for this problem has not been found as yet.

Under the circumstances, a silicone rubber of two-part condensation reaction cure type has been generally employed as a material for the heat resistant rubber elastic layer 32. The reason for this is that since this raw material is liquid of low viscosity, it is suited for filling a large amount of thermal conductivity-improving agent to the rubber compound. However, this silicone rubber takes one to three weeks for cross-linking or curing, making it disadvantageous in productivity. As another kind of material for the heat resistance rubber elastic layer, a silicon rubber of peroxide cross-linking type has been proposed. However, since this raw material is high in viscosity, it is impossible to fill a large amount of thermal conductivity-improving agent to the rubber compound and hence to obtain a desired thermal conductivity.

Further, a silicone rubber of two-part addition reaction cure type may be employed as a material for the heat resistant rubber elastic layer. Since this raw material is low in viscosity, a large amount of thermal conductivity-improving agent can be filled into the rubber compound. At the same time, this raw material enables a high speed cross-linking and curing of the raw material to be achieved, thereby making it possible to attain an excellent productivity. This silicone rubber of two-part addition reaction cure type is described in detail in U.S. Pat. No. 2,823,218. This silicone rubber of two-part addition reaction cure type however is also accompanied with the same problem as in the case of the silicone rubber of two-part condensation reaction cure type that it can be easily abraded by the side edges of paper sheet. Although the reason for this is not yet clear, it can be presumably ascribed to a poor compatibility between the silicone rubber polymer and alumina powder to be added as a thermal conductivity-improving agent. The reasons for employing alumina powder in general are that it is cheap and readily available in the market, and that a high thermal conductive rubber can be obtained with an addition of a little amount of alumina powder. As an alternative cheap raw material, quartz powder ($SiO_2$) can be employed.

Alumina powder to be added to a rubber material should preferably be selected from those having a particle diameter of about 3 to 20 $\mu$m.

Generally, the thickness of the heat resistance rubber elastic layer is in the range of 700 to 2,000 $\mu$m, and the thermal conductivity of thereof is in the range of 1.5 to $2.5\times10^{-3}$cal/cm·sec·°C. The rubber hardness (Shore A) of the heat resistance rubber elastic layer is 65° to 80° in general. The durability of roll, which is determined by the edge abrasion of the roll due to a friction with paper sheet, may be at most about $300\times10^3$ sheets in the number of copy.

By the way, in the case of a high speed printer, since the time period within which the base material 24 passes through the nipping portion (a nipping time) is very short, it may become impossible for a heat-fixing roll having an ordinary heat resistant rubber elastic surface layer to be heated up to a sufficient temperature before it is brought again to the nipping portion (after one rotation of the roll) and hence to supply a sufficient quantity of heat to the toner for fusing the toner. As a result, the fixing may become insufficient in such a case.

BRIEF SUMMARY OF THE INVENTION

An object of the present invention is to provide a heat-fixing roll which is capable of minimizing the abrasion by a base material even under the conditions of a high rotation speed, a high load and a large nipping width, and which is excellent in durability.

Another object of the present invention is to improve the abrasion resistance of a heat-fixing roll by adding an alumina powder, a quartz powder or a mixture of alumina powder and quartz powder to a silicone rubber compound of addition reaction curing type.

Namely, according to this invention, there is provided a heat-fixing roll for a fixing device which comprises a core shaft, and a rubber layer formed on an outer peripheral surface of said core shaft; wherein said rubber layer is formed of a silicone rubber compound of addition reaction curing type having a thermal conductivity of $1.5\times10^{-3}$cal/cm·sec ·°C. or more and containing 1.5 parts by weight or more of silicone resin powder having an average particle diameter of 1 to 20 $\mu$m per 100 parts by weight of said silicone rubber compound.

According to this invention, since the rubber layer is formed of a silicone rubber compound of addition reaction curing type having a thermal conductivity of $1.5\times10^{-3}$cal/cm·sec ·°C. or more and containing 1.5 parts by weight or more of silicone resin powder having an average particle diameter of 1 to 20 $\mu$m per 100 parts by weight of said silicone rubber compound, it is possible to realize a heat-fixing roll of enhanced durability, which is capable of minimizing the abrasion by paper sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
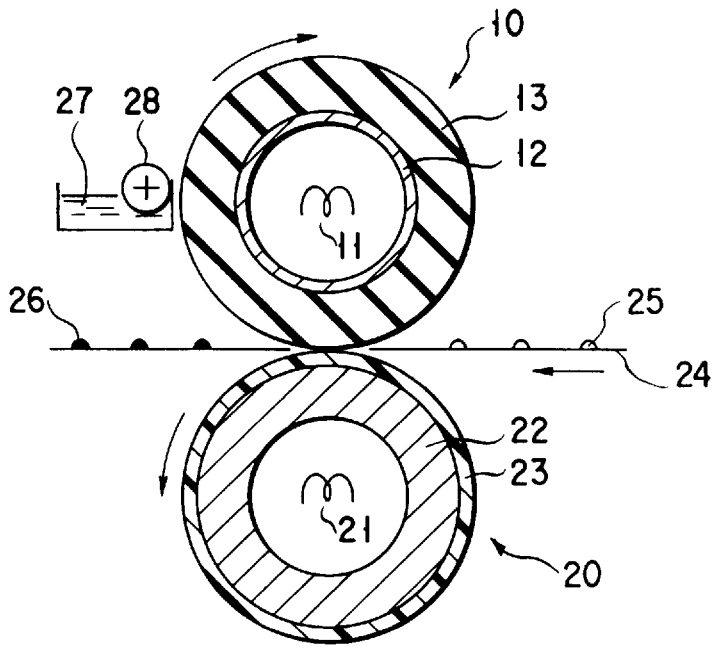
FIG. 1 (PRIOR ART)
FIG. 1 is a cross-sectional view schematically illustrating a conventional fixing device.
Figure 2:
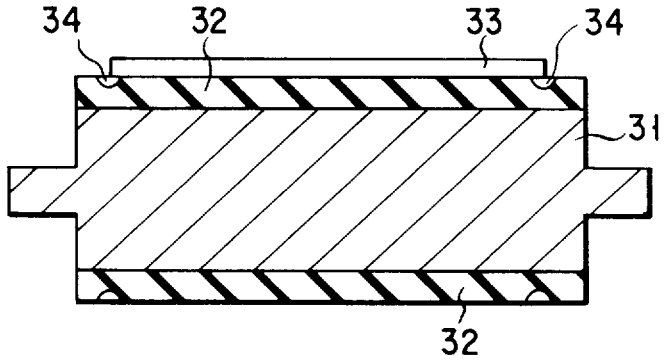
FIG. 2 (PRIOR ART)
FIG. 2 is a cross-sectional view of a conventional heat-fixing roll.

The silicone rubber compound according to this invention should preferably be mixed therein with a thermal conductivity-improving agent selected from the group consisting of alumina powder, quartz powder and a mixture of alumina powder and quartz powder. These thermal conductivity-improving agents also have a function to improve resistance to thermal deformation of a roll. Examples of composition containing alumina are described for example in Japanese Patent Publication No. Shou/58-22055; Japanese Unexamined Patent Publication No. Shou/64-69661; Japanese Unexamined Patent Publication No. Hei/4-328163; Japanese Unexamined Patent Publication No. Shou/63-251466; and Japanese Unexamined Patent Publication No. Hei/2-41362. Further, examples the heat-fixing roll are described for example in U.S. Pat. No. 3,763,158. Examples of heat-fixing roll formed of a silicone rubber containing a silicone resin powder for improving the releasability of the roll are described in Japanese Unexamined Patent Publication No. Shou/61-158262.

Examples of the silicone rubber of addition reaction curing type which are useful in this invention are STYCAST 5952, 5954 or 5877 (tradenames of W. R Grace & Co., Conn. Corp.); TSE-3320, 3380, 3281 (tradenames of General Electric Co.); DC3-6395 (a tradename of Dow Corning Corp.).

The silicone resin powder is employed in this invention for the purpose of improving the abrasion resistance of the silicone rubber. One example of this silicone resin powder is polymethylsilsesquioxane fine particle which is three-dimensionally crosslinked and represented by the chemical formula $(CH_3SiO_{3/2})_n$. This polymethylsilsesquioxane fine particle is available from Shin-Etsu Chemical Co., Ltd. in the tradename of KMP590, X-52-854, X-52-821, X-52-830, X-52-831, X-52-1032, X-52-1139K and X-52-1139G. Among them, X-52-821, X-52-830 and X-52-831 are formed of a resin powder having on its surface a functional group such as vinyl group, epoxy group or amino group. Whereas X-52-1139K and X-52-1139G are formed of a powder of 2-ply structure comprising a core silicone rubber powder coated thereon with a silicone resin layer. These powders are also useful as a silicone resin powder.

The reason for limiting the average particle diameter of the silicon resin powder to the range of 1 to 20 μm is that if the particle diameter is less than 1 μm, the rise in viscosity as the silicone resin powder is added to the rubber compound becomes too excessive, whereas if the particle diameter exceeds over 20 μm, pin holes may be generated due to the falling of the particles. Therefore, a preferable range of particle diameter of the silicone resin powder is from 1 to 20 μm. Incidentally, each of these silicone resin powders has an average particle diameter of about 0.8 to 20 μm.

The mixing ratio of the silicone resin powder to the silicone rubber compound should preferably be 1.5 to 30 parts by weight per 100 weight parts of the silicone rubber compound. If the mixing ratio of the silicone resin powder is less than 1.5 parts by weight, any satisfactory improvement in copying durability cannot be expected, whereas if the mixing ratio of the silicone resin powder exceeds over 30 parts by weight, a problem of processability would be raised due to an increase in viscosity at the occasion of molding the roll, and at the same time the rubber hardness of the roll becomes 85° or more in Shore hardness, raising a problem in fixing property of the roll.

The compound to be employed for forming the rubber layer in this invention may further contain if demanded a non-reactive silicone oil, an adhesion-promoting agent such as a silane coupling agent, a thickening agent such as fumed silica, an antistatic agent such as carbon black or a surfactant, or a solvent functioning as a viscosity modifier.

EXAMPLES

Figure 3:
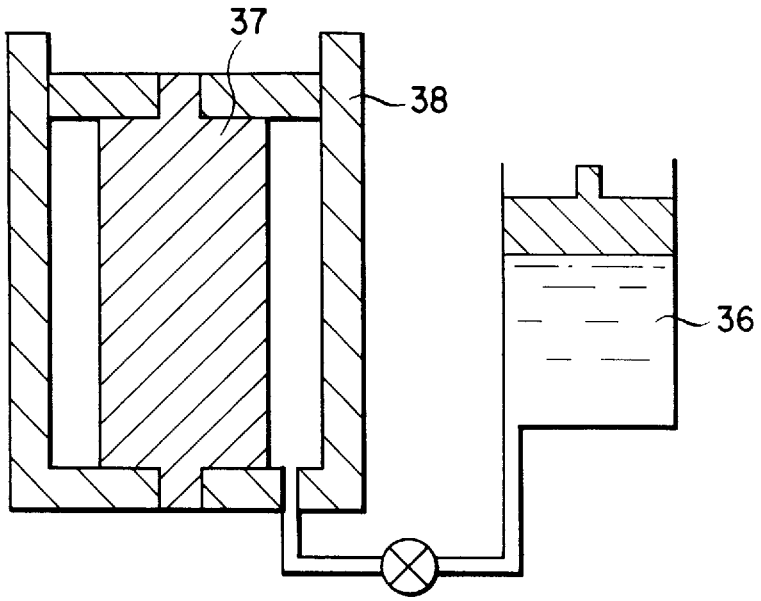
FIG. 3 is a cross-sectional view illustrating an apparatus for manufacturing a heat-fixing roll of the present invention.

A method of molding the heat-fixing rolls according to the following Examples 1 to 6 and Comparative Examples 1 to 10 will be explained with reference to FIG. 3.

(Examples 1 to 6 and Comparative Examples 3 to 10)

First of all, a predetermined quantity of silicone resin powder having an average particle diameter ranging from 1 to 20 μm was added to the aforementioned high thermal conductive silicone rubber material, and, after being kneaded for 15 minutes, subjected to a deaeration treatment thereby to obtain an addition reaction cure type silicone rubber compound 36 containing the silicone resin powder. Meanwhile, a core shaft 37 which has been degreased in advance was surface-treated with a primer adhesive to prepare the core shaft 37 having an outer diameter of 72 mm, which was then set in a mold 38 having an inner diameter of 78 mm. Then, the compound 36 was injected from a lower portion of the mold 38 into the space formed between the core shaft 37 and the mold 38. Then, the mold 38 with the core shaft 37 being set therein was introduced into a thermostatic oven to perform the curing of the compound 36 for one hour at a temperature of 150° C. After being removed out of the mold, the cured compound 36 was further subjected to a post curing for four hours at a temperature of 200° C., and then to a surface grinding to obtain an aimed heat-fixing roll having an outer diameter of 76 mm.

On the other hand, a silicone rubber compound of condensation reaction curing type was employed in place of the aforementioned addition reaction cure type silicone rubber compound to a heat-fixing roll in the same manner as mentioned above, i.e. by selecting a suitable mixing ratio of the components and by employing suitable methods (Comparative Examples 1 and 2).

However, in these Comparative Examples 1 and 2 wherein silicone rubber compound of condensation reaction curing type was employed, the curing of the compound was performed after injecting the compound from a lower portion of the mold at room temperature for one week, and then the post curing of the compound after being removed out of the mold was performed for four hours at a temperature of 200° C., which was followed by the surface grinding thereof to obtain a heat-fixing roll having an outer diameter of 76 mm.

In the same manner as explained above, various kinds of compounds were prepared and various kinds of heat-fixing rolls having the same outer diameter as mentioned above were molded. The mixing ratios (the mixing ratios all are indicated by weight) of these various compounds were as shown in the following Tables 1 to 7.

TABLE 1

| | Comparative Example 1 | Comparative Example 2 |
|---|---|---|
| Condensation reaction cure type silicone rubber (1) | 100 | 100 |
| Condensation reaction cure type catalyst (2) | 0.5 | 0.5 |
| Silicone resin powder (3) | — | 8 |

(Note)
(1): ECOSIL 4952 (tradename; W. R. Grace & Co.)
(2): CATALYST 50 (tradename; W. R. Grace & Co.)
(3): KMP-590 (tradename; Shin-Etsu Chemical Co., Ltd.)

TABLE 2

| | Comparative Example 3 | Comparative Example 4 |
|---|---|---|
| Addition reaction cure type silicone rubber (1) | 100 | 100 |
| Addition reaction cure type silicone rubber (2) | 10 | 10 |
| Silicone resin powder (3) | — | 8 |

(Note)
(1): STYCAST 5877A (tradename; W. R. Grace & Co.)
(2): STYCAST 5877B (tradename; W. R. Grace & Co.)
(3): KMP-590 (tradename; Shin-Etsu Chemical Co., Ltd.)

TABLE 3

| | Comparative Example 5 | Comparative Example 6 |
|---|---|---|
| Addition reaction cure type silicone rubber (1) | 40 | 40 |
| Addition reaction cure type silicone rubber (2) | 4 | 4 |
| Addition reaction cure type silicone rubber (4) | 30 | 30 |
| Addition reaction cure type silicone rubber (5) | 30 | 30 |
| Silicone resin powder (3) | — | 8 |

(Note)
(1): STYCAST 5877A (tradename; W. R. Grace & Co.)
(2): STYCAST 5877B (tradename; W. R. Grace & Co.)
(3): KMP-590 (tradename; Shin-Etsu Chemical Co., Ltd.)
(4): G.E. TSE-3320A (tradename; General Electric Co.)
(5): G.E. TSE-3320B (tradename; General Electric Co.)

TABLE 4

| | Comparative Example 7 | Example 1 |
|---|---|---|
| Addition reaction cure type silicone rubber (4) | 50 | 50 |
| Addition reaction cure type silicone rubber (5) | 50 | 50 |
| Silicone resin powder (3) | — | 8 |

(Note)
(3): KMP-590 (tradename; Shin-Etsu Chemical Co., Ltd.)
(4): G.E. TSE-3320A (tradename; General Electric Co.)
(5): G.E. TSE-3320B (tradename; General Electric Co.)

TABLE 5

| | Comparative Example 8 | Example 2 |
|---|---|---|
| Addition reaction cure type silicone rubber (6) | 50 | 50 |
| Addition reaction cure type silicone rubber (7) | 50 | 50 |
| Silicone resin powder (3) | — | 8 |

(Note)
(3): KMP-590 (tradename; Shin-Etsu Chemical Co., Ltd.)
(6): D.C 3-6395A (tradename; Dow Corning Corp.)
(7): D.C 3-6395B (tradename; Dow Corning Corp.)

TABLE 6

| | Comparative Example 9 | Example 3 |
|---|---|---|
| Addition reaction cure type silicone rubber (8) | 50 | 50 |
| Addition reaction cure type silicone rubber (9) | 50 | 50 |
| Silicone resin powder (3) | — | 8 |

(Note)
(3): KMP-590 (tradename; Shin-Etsu Chemical Co., Ltd.)
(8): STYCAST 5952A (tradename: W. R. Grace & Co.)
(9): STYCAST 5952B (tradename: W. R. Grace & Co.)

TABLE 7

| | Comparative Example 10 | Example 4 | Example 5 | Example 6 |
|---|---|---|---|---|
| Addition reaction cure type silicone rubber (6) | 50 | 50 | 50 | 50 |
| Addition reaction cure type silicone rubber (7) | 50 | 50 | 50 | 50 |
| Silicone resign powder (3) | 0.8 | 1.5 | 4.0 | 20.0 |

(Note)
(3): KMP-590 (tradename; Shine-Etsu Chemical Co., Ltd.)
(6): D.C.3-6395A (tradename; Dow Corning Corp.)
(7): D.C.3-6395B (tradename; Dow Corning Corp.)

The hardness and thermal conductivity of the heat-fixing rolls and the number of sheet which could be copied with these heat-fixing rolls in Comparative Examples 1 to 10 and Examples 1 to 6 were as shown in following Tables 8 and 9.

TABLE 8

| | Hardness Shore A | Thermal conductivity ($\times 10^{-3}$) cal/cm · sec · °C. | Number of sheets ($\times$ 1000 copies) |
|---|---|---|---|
| Comparative Example 1 | 70 | 2.60 | 327 |
| Comparative Example 2 | 72 | 2.57 | 230 |
| Comparative Example 3 | 65 | 0.71 | 120 |
| Comparative Example 4 | 67 | 0.69 | 110 |
| Comparative Example 5 | 67 | 1.23 | 240 |
| Comparative Example 6 | 69 | 1.21 | 230 |
| Comparative Example 7 | 70 | 1.52 | 245 |
| Comparative Example 8 | 70 | 1.69 | 256 |
| Comparative Example 9 | 75 | 2.58 | 275 |
| Comparative Example 10 | 70 | 1.69 | 370 |

TABLE 9

| | Hardness Shore A | Thermal conductivity ($\times 10^{-3}$) cal/cm · sec · °C. | Number of sheets ($\times$ 1000 copies) |
|---|---|---|---|
| Example 1 | 73 | 1.50 | 550 |
| Example 2 | 72 | 1.68 | 650 |
| Example 3 | 77 | 2.52 | 620 |
| Example 4 | 70 | 1.69 | 520 |
| Example 5 | 71 | 1.68 | 630 |
| Example 6 | 78 | 1.54 | 560 |

In these Tables 8 and 9, the hardness of the rubber layers (12 mm in thickness) was measured using a Shore durometer which is available from Instron Co. (tradename: ASTM D-2240 Shore Durometer Type A). The thermal conductivity the heat-fixing rolls was measured using a conductivity meter which is available from Kyoto-Electronics Manuf. Co., Ltd. (tradename: Kem Therm QTM-D3). The number of sheet that could be copied was measured by actually mounting the heat-fixing rolls on a high speed copying machine which is available from Xerox Co. (tradename: #1075).

Figure 4:
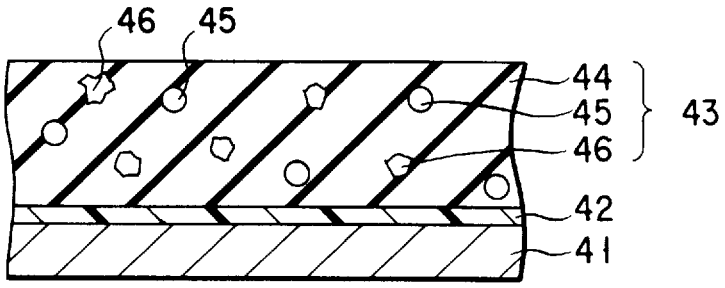
FIG. 4 is an enlarged cross-sectional view illustrating a state of rubber layer of a heat-fixing roll according to the present invention.

The heat-fixing rolls according to Examples 1 to 6 were formed, as shown in FIG. 4, of a core shaft 41, and a rubber layer 43 which was formed via a primer adhesive layer 42 on the outer peripheral surface of the core shaft 41. The rubber layer 43 was formed of an addition reaction cure type silicone rubber compound 44 which has a thermal conductivity of $1.5\times10^{-3}$cal/cm·sec ·°C. or more and which contains alumina 46 and 1.5 parts or more by weight of silicone resin powder 45 having a particle diameter of 1 to 20 $\mu$m. Therefore, according to Examples 1 to 6, it was possible to obtain heat-fixing rolls which is capable of minimizing an abrasion by paper sheet and is excellent in durability. On the other hand, in the cases of Comparative Examples, it was impossible to obtain a heat-fixing roll of excellent durability. As a matter of fact, the followings have been made clear from Tables 8 and 9.

(1) Even if the thermal conductivity of rubber layer was $1.5\times10^{-3}$cal/cm·sec ·°C. or more, the number of sheet that could be copied would be relatively small, if the rubber layer was formed of a condensation reaction cure type silicone rubber compound (Comparative Examples 1 and 2).

(2) Even if an addition reaction cure type silicone rubber compound was employed, the number of sheet that could be copied would be relatively small, if the thermal conductivity of rubber layer was less than $1.5\times10^{-3}$cal/cm·sec ·°C. (Comparative Examples 3 to 6).

(3) Even if an addition reaction cure type silicone rubber compound was employed and the thermal conductivity of rubber layer was $1.5\times10^{-3}$cal/cm·sec ·°C. or more, the number of sheet that could be copied would be relatively small, if the content of the silicone resin powder is less than 1.5 parts by weight (Comparative Examples 7 to 10).

(4) By contrast, when the thermal conductivity of rubber layer was $1.5\times10^{-3}$cal/cm·sec ·°C. or more, and the content of the silicone resin powder is not less than 1.5 parts by weight, the number of sheet that could be copied would become relatively large as compared with that obtainable in any of Comparative Examples 1 to 10 (Examples 1 to 6).

Although the content of the silicone resin powder was set to 1.5, 4.0 and 20.0 parts by weight in the aforementioned Examples, the content of the silicone resin is not limited to these examples, but may be suitable selected as long as the content thereof is not less than 1.5 parts by weight. Further, the thermal conductivity of the addition reaction cure type silicone rubber compound is not limited to those described in these Examples.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A heat-fixing roll which comprises a core shaft, and a rubber layer formed on an outer peripheral surface of said core shaft; wherein said rubber layer is formed of a silicone rubber compound of addition reaction curing type having a thermal conductivity of $1.5\times10^{-3}$cal/cm·sec·°C. or more and containing 1.5 parts by weight or more of silicone resin powder having an average particle diameter of 1 to 20 $\mu$m per 100 parts by weight of said silicone rubber compound.

2. The heat-fixing roll according to claim 1, wherein said thermal conductivity-improving agent is selected from the group consisting of alumina powder, quartz powder and a mixture of alumina powder and quartz powder.

3. The heat-fixing roll according to claim 1, wherein said silicone resin powder is polymethylsilsesquioxane fine particle which is three-dimensionally crosslinked and represented by the chemical formula $(CH_3SiO_3)_n$.

4. The heat-fixing roll according to claim 1, wherein said silicone rubber compound further contain a non-reactive silicone oil, an adhesion-promoting agent such as a silane coupling agent, a thickening agent such as fumed silica, an antistatic agent such as carbon black or a surfactant, or a solvent functioning as a viscosity modifier.

* * * * *

UNITED STATES PATENT AND TRADEMARK OFFICE

CERTIFICATE OF CORRECTION

PATENT NO. : 5,803,887
DATED : September 8, 1998
INVENTOR(S) : Noritomo Fukunaga It is certified that error appears in the above-identified patent and that said Letters Patent is hereby corrected as shown below:

On the title page, item [56] insert the following References:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 59 | 2 | 0 | 9 | 1 | 2 | 9 | 11/84 | Japan | | | | |
| | | | 3 | 2 | 6 | 9 | 4 | 7 | 2/91 | Japan | | | | |
| | | 8 | 2 | 7 | 2 | 2 | 5 | 3 | 10/96 | Japan | | | | |
| | | | 8 | 7 | 6 | 6 | 2 | 5 | 3/96 | Japan | | | | |
| | | | 58 | 2 | 2 | 0 | 5 | 5 | 5/83 | Japan | | | | |
| | | | 64 | 6 | 9 | 6 | 6 | 1 | 3/89 | Japan | | | | |
| | | 4 | 3 | 2 | 8 | 1 | 6 | 3 | 11/92 | Japan | | | | |
| | | 63 | 2 | 5 | 1 | 4 | 6 | 6 | 10/88 | Japan | | | | |
| | | | 2 | 4 | 1 | 3 | 6 | 2 | 2/90 | Japan | | | | |
| | | 61 | 1 | 5 | 8 | 3 | 6 | 2 | 7/86 | Japan | | | | |

Signed and Sealed this

Ninth Day of March, 1999

*Attest:*

Q. TODD DICKINSON

*Attesting Officer*

*Acting Commissioner of Patents and Trademarks*